US011143993B2

(12) United States Patent
Jeong

(10) Patent No.: US 11,143,993 B2
(45) Date of Patent: Oct. 12, 2021

(54) METHOD FOR CONTROLLING FUSER USING WAVEFORM NUMBER OR PHASE CONTROL BASED ON OPERATION MODE

(71) Applicant: Hewlett-Packard Development Company, L.P., Spring, TX (US)

(72) Inventor: Jong Hu Jeong, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/050,028

(22) PCT Filed: Dec. 3, 2018

(86) PCT No.: PCT/KR2018/015177
§ 371 (c)(1),
(2) Date: Oct. 23, 2020

(87) PCT Pub. No.: WO2020/027387
PCT Pub. Date: Feb. 6, 2020

(65) Prior Publication Data

US 2021/0072674 A1 Mar. 11, 2021

(30) Foreign Application Priority Data

Jul. 31, 2018 (KR) ..... 10-2018-0089480

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/5004* (2013.01)

(58) Field of Classification Search
CPC ..... G03G 15/205; G03G 15/5004; G03G 15/2039; G03G 15/2042
USPC ..... 399/69, 70, 334; 219/216
See application file for complete search history.

(56) References Cited

U.S. PATENT DOCUMENTS

| | | | | |
|---|---|---|---|---|
| 6,853,818 | B2 * | 2/2005 | Nishida | G03G 15/2039 399/67 |
| 9,213,280 | B2 * | 12/2015 | Nagasaki | G03G 15/205 |
| 10,663,900 | B2 * | 5/2020 | Yada | G03G 15/5004 |
| 2005/0061797 | A1 | 3/2005 | Kim et al. | |
| 2008/0025745 | A1 | 1/2008 | Shin et al. | |
| 2010/0028037 | A1 | 2/2010 | Song | |

(Continued)

FOREIGN PATENT DOCUMENTS

| | | | |
|---|---|---|---|
| JP | 2009-69426 A | | 4/2009 |
| JP | 2013029746 A | * | 2/2013 |

(Continued)

*Primary Examiner* — Robert B Beatty
(74) *Attorney, Agent, or Firm* — Jefferson IP Law, LLP

(57) ABSTRACT

An image forming apparatus is provided. The image forming apparatus according to an example includes a print engine including a fuser, a power supply apparatus to selectively provide AC power to the fuser, and a processor to control the power supply apparatus to selectively provide AC power to the fuser, wherein the processor, based on an operation mode of the image forming apparatus being a print mode, performs waveform number control of the AC power provided to the fuser, and, based on the operation mode of the image forming apparatus being an operation mode except for the print mode, performs phase control of the AC power provided to the fuser.

19 Claims, 10 Drawing Sheets

(56) References Cited

U.S. PATENT DOCUMENTS

| | | | | |
|---|---|---|---|---|
| 2010/0322656 | A1* | 12/2010 | Chosokabe | G03G 15/2039 399/67 |
| 2011/0142475 | A1 | 6/2011 | Kim | |
| 2016/0044745 | A1* | 2/2016 | Nakayama | H05B 1/0241 219/481 |
| 2016/0062284 | A1 | 3/2016 | Song et al. | |
| 2016/0327898 | A1* | 11/2016 | Fujiwara | G03G 15/2039 |
| 2017/0108806 | A1 | 4/2017 | Song et al. | |
| 2017/0248894 | A1* | 8/2017 | Yada | G03G 15/2039 |

FOREIGN PATENT DOCUMENTS

| | | | | |
|---|---|---|---|---|
| JP | 2018151518 | A * | 9/2018 | |
| WO | WO-2019017557 | A1 * | 1/2019 | G03G 21/18 |

* cited by examiner

[Fig. 1]
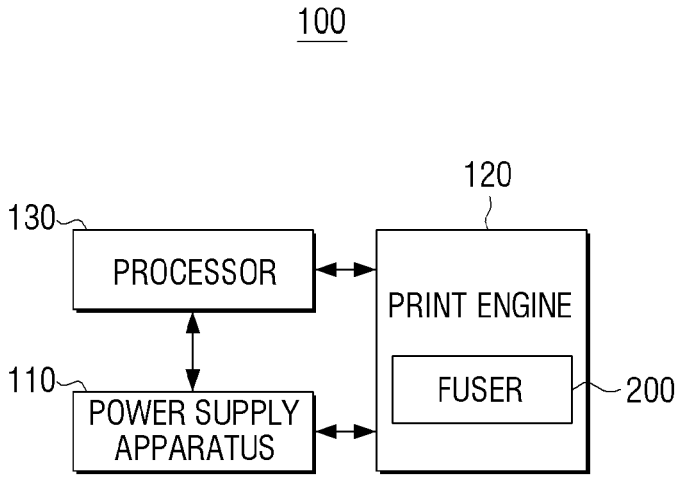
[Fig. 2]
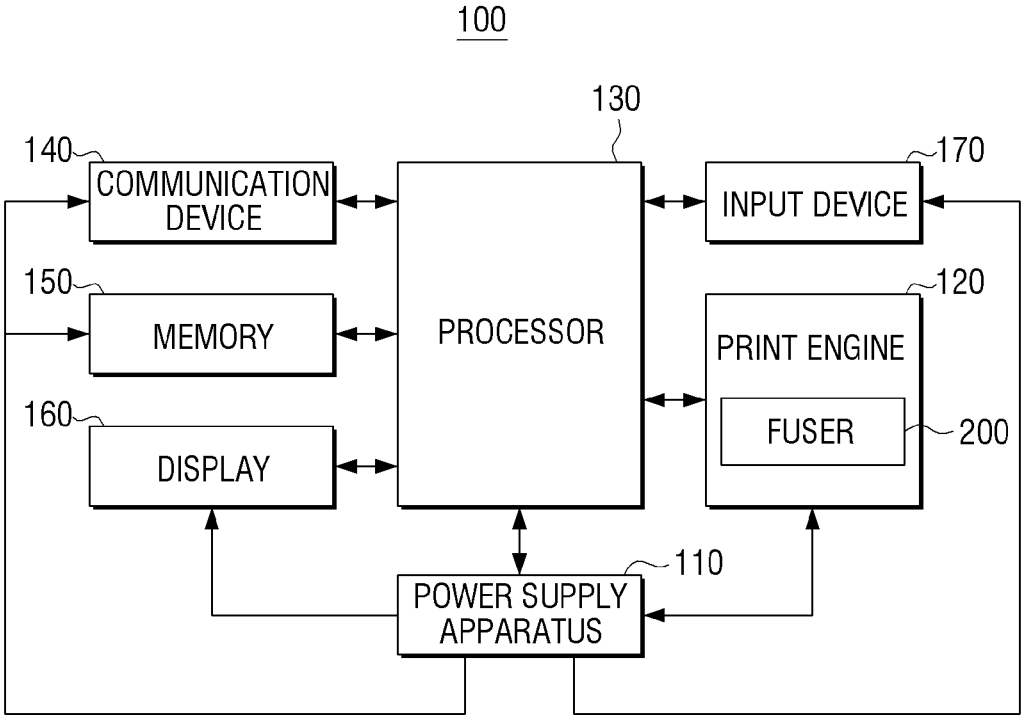

[Fig. 3]
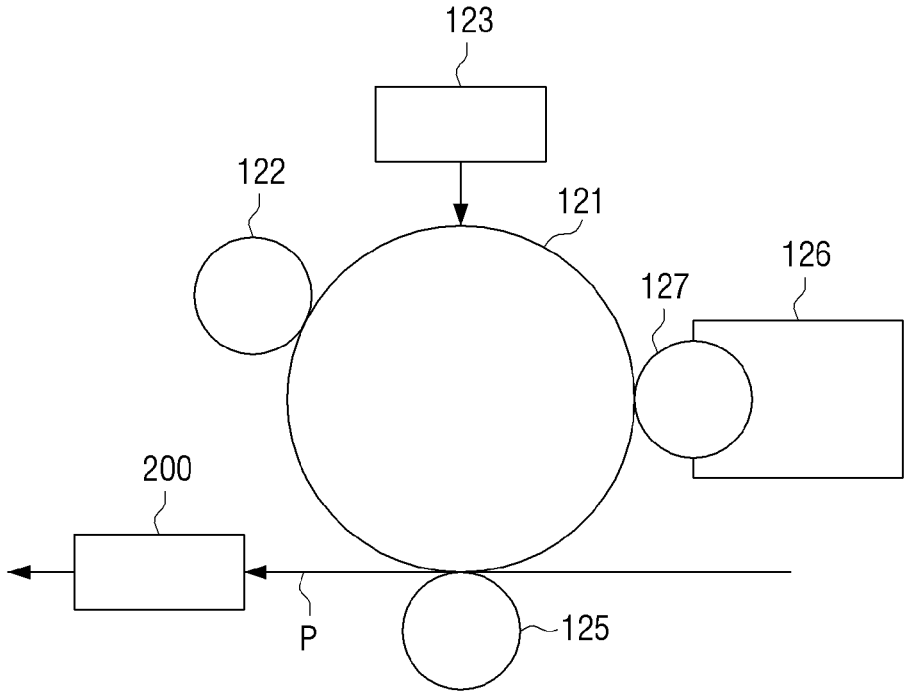
[Fig. 4]
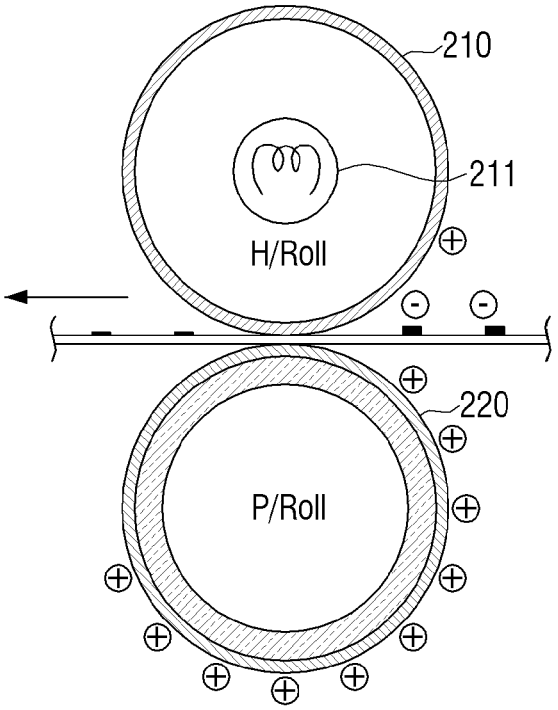

[Fig. 5]
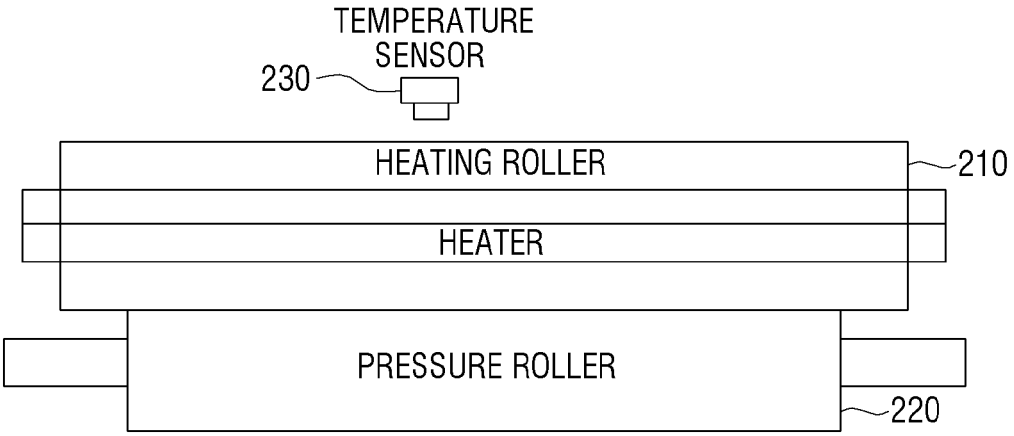
[Fig. 6]
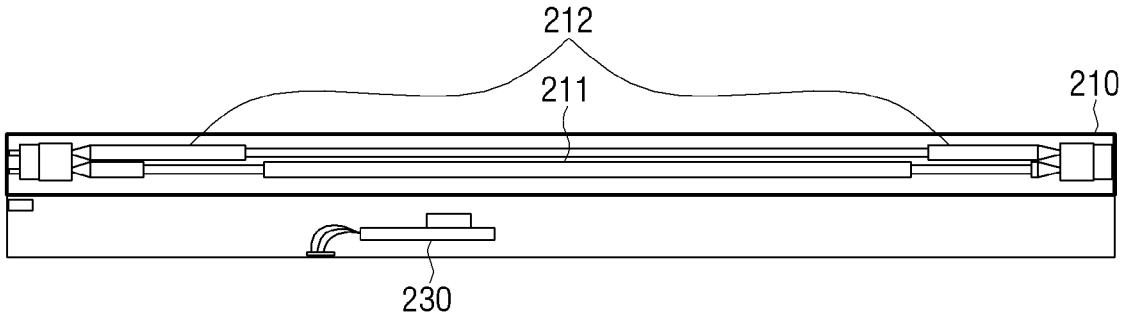

[Fig. 7]

| Center (Lamp 1) | Side(Lamp 2) |
|---|---|
| 16.7% | 16.7% |
| | 25% |
| | 33% |
| | 50% |
| 25% | 16.7% |
| | 25% |
| | 33% |
| | 50% |
| 33% | 16.7% |
| | 25% |
| | 33% |
| | 50% |
| 50% | 16.7% |
| | 25% |
| | 33% |
| | 50% |

[Fig. 8]
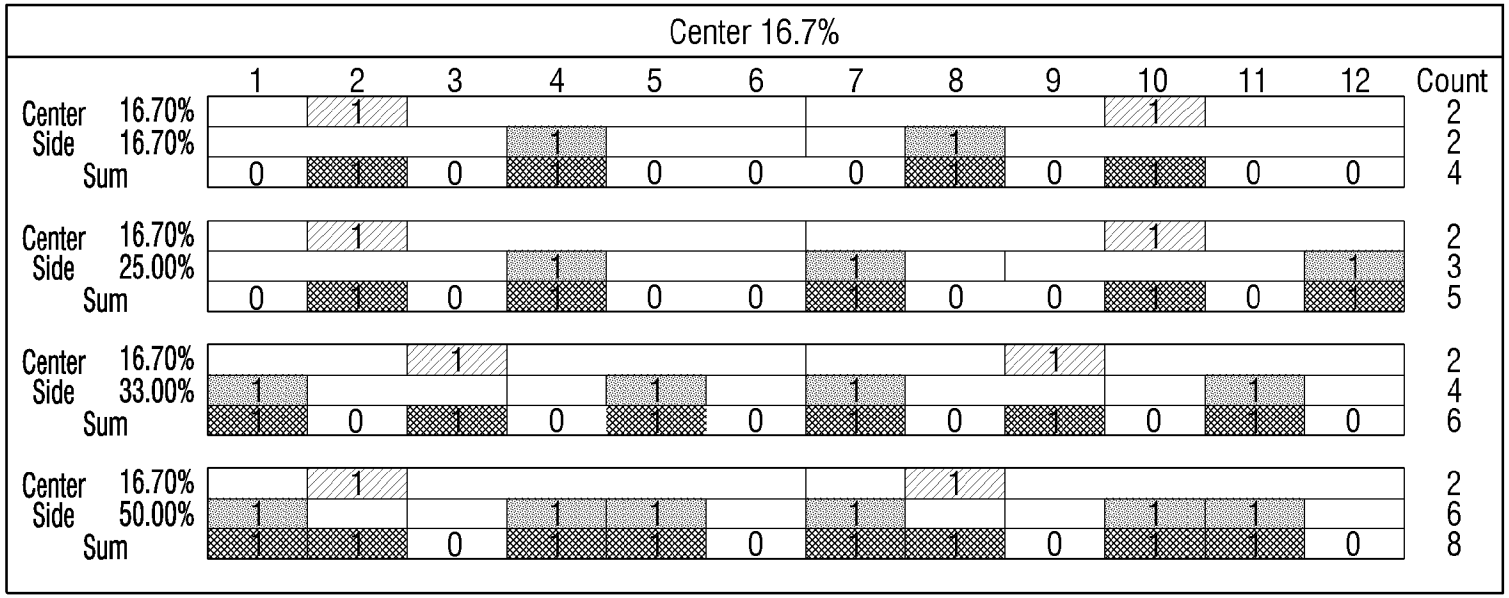

[Fig. 9]
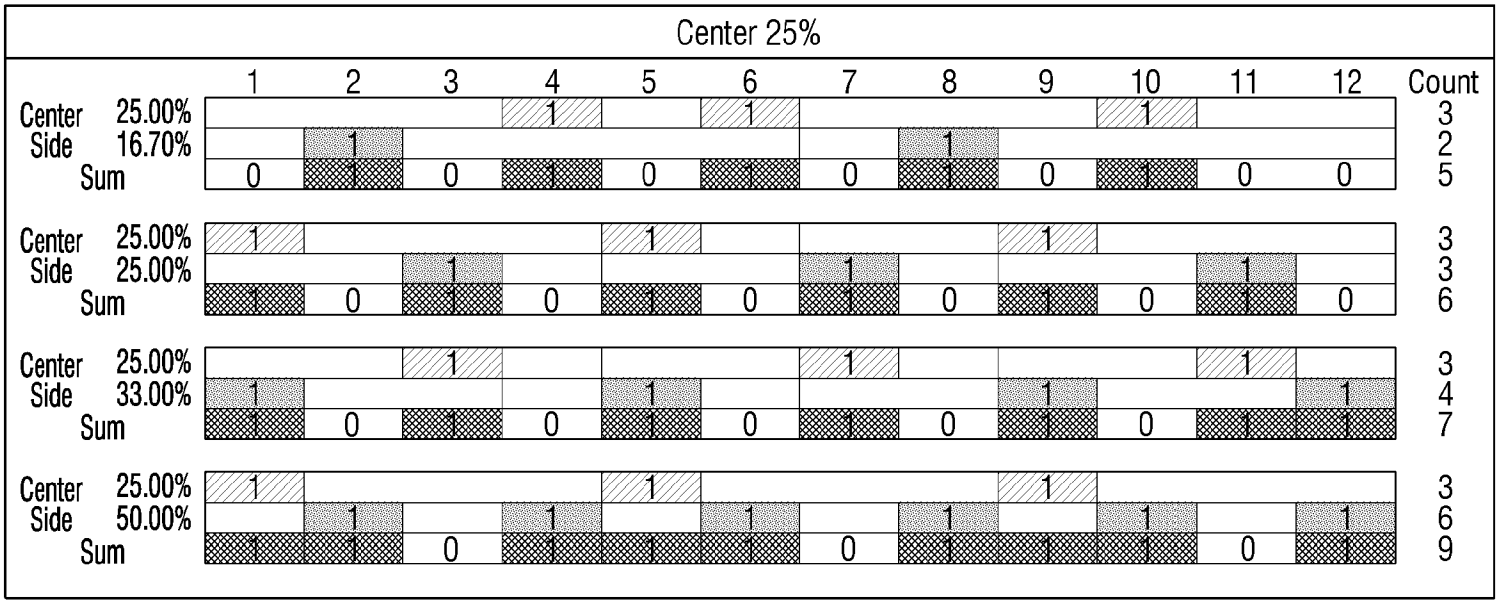

[Fig. 10]
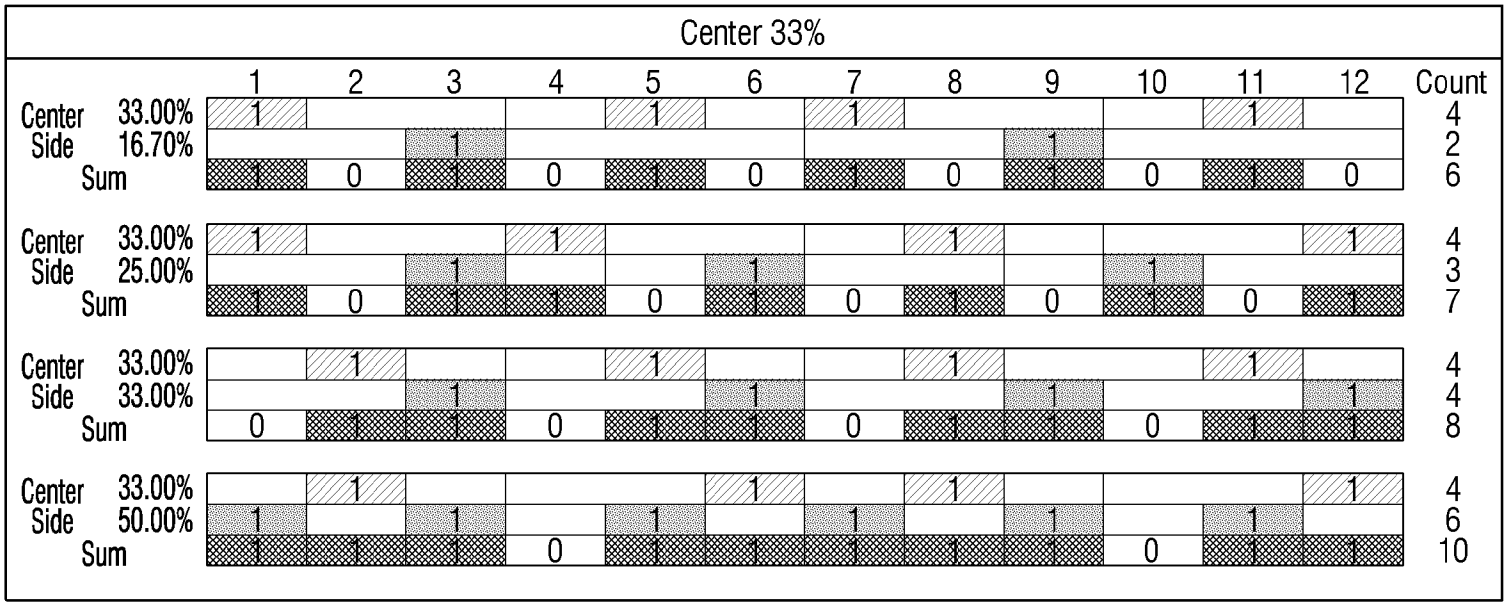

[Fig. 11]
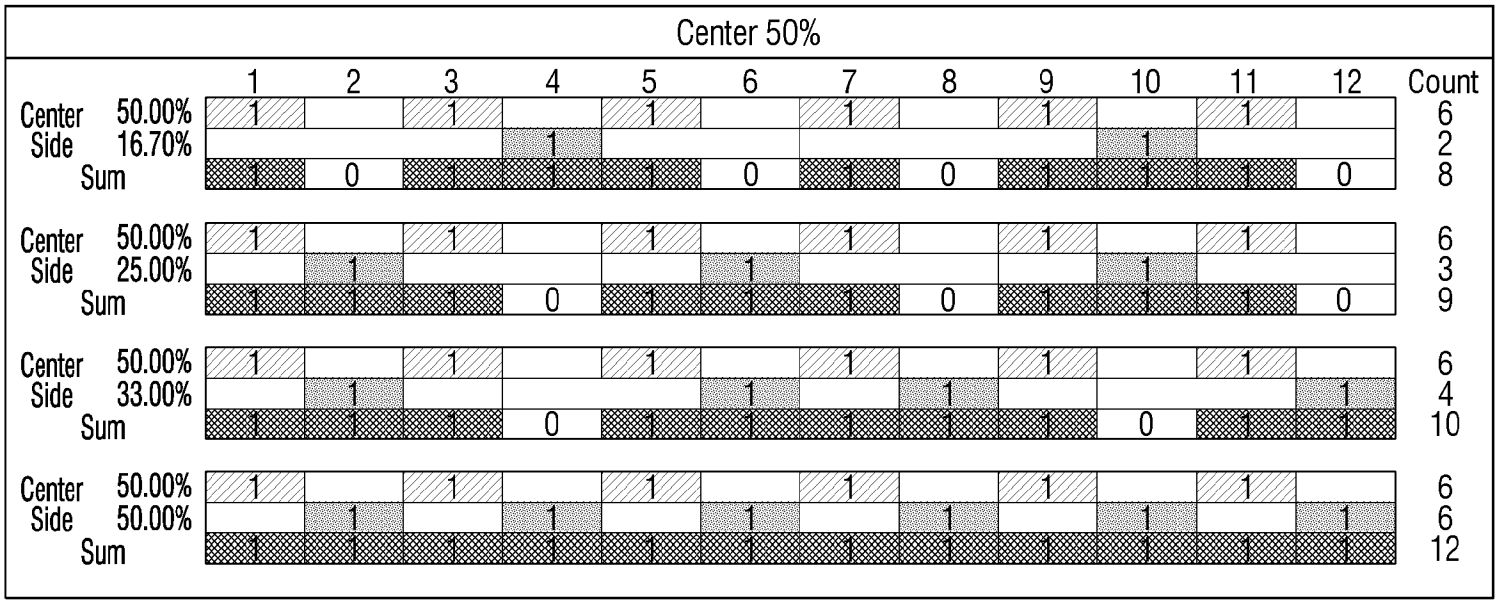

[Fig. 12]
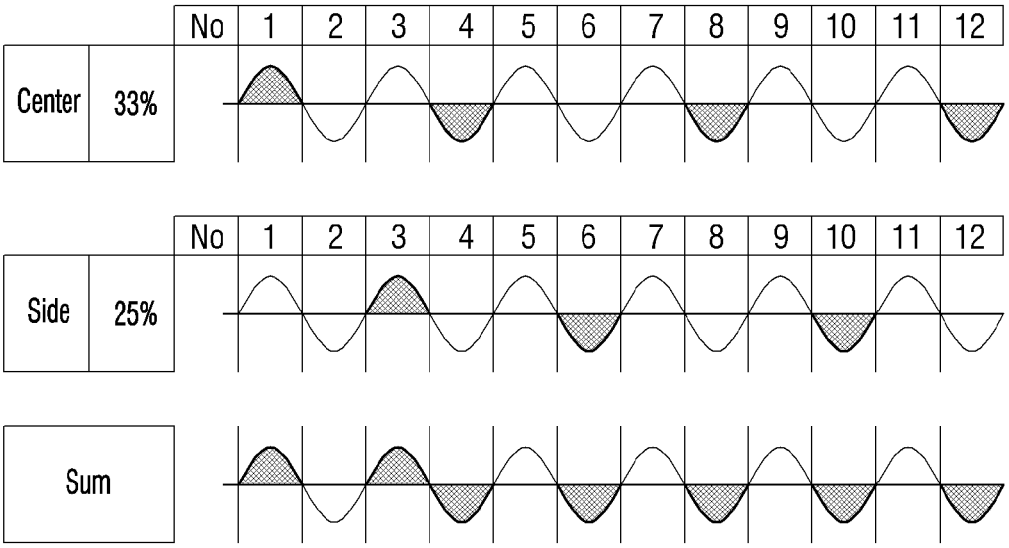
[Fig. 13]
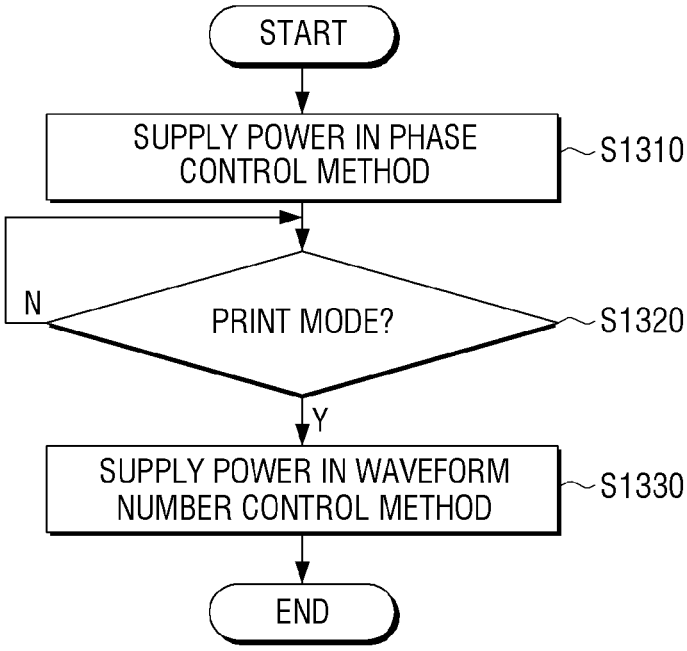

[Fig. 14]
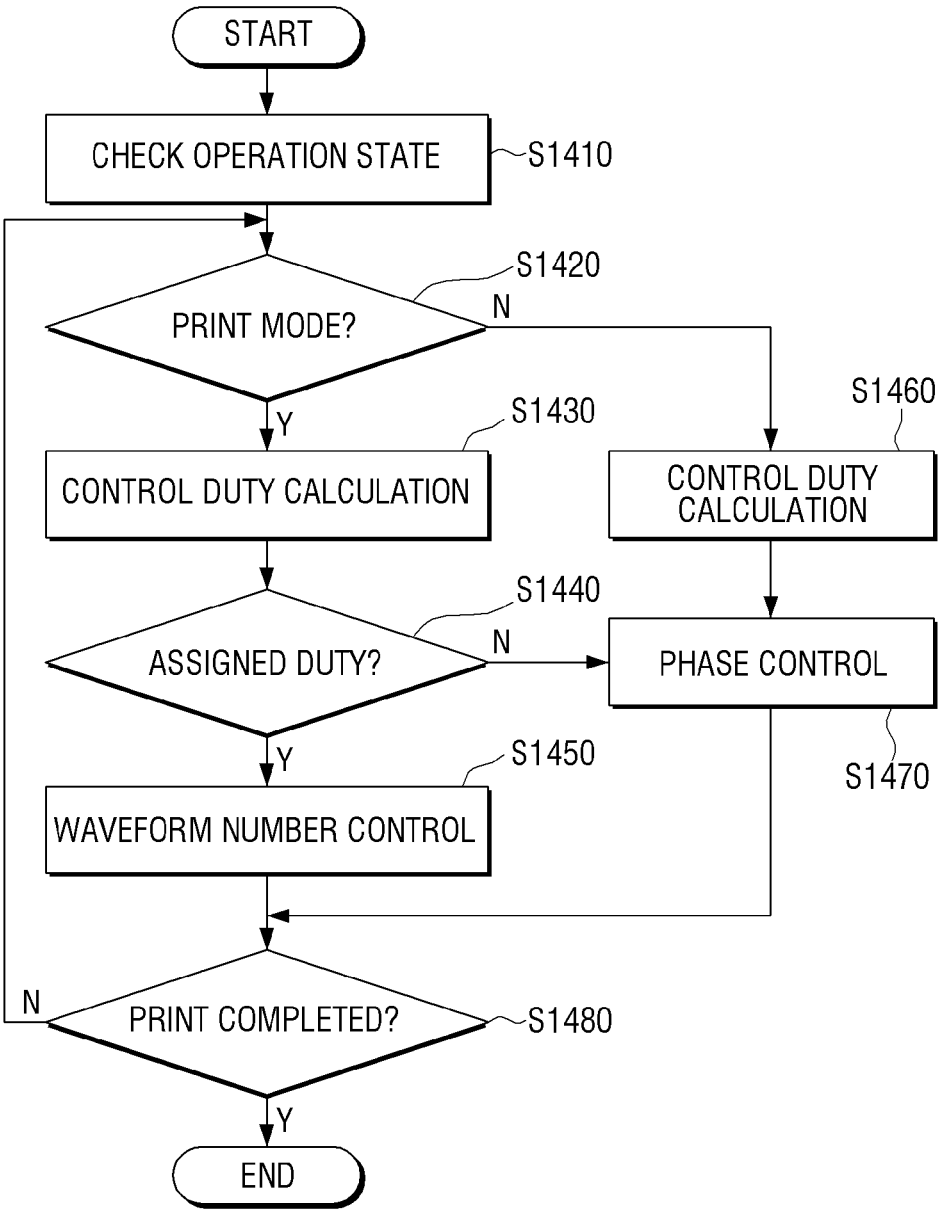

METHOD FOR CONTROLLING FUSER USING WAVEFORM NUMBER OR PHASE CONTROL BASED ON OPERATION MODE

BACKGROUND ART

An image forming apparatus is an apparatus for printing data generated by a print control terminal device such as a computer on printing paper. Examples of the image forming apparatus include a printer, a scanner, a copier, a facsimile, and a multi-function peripheral (MFP) integrally incorporating these functions.

An image forming apparatus may form an image by using various methods. One of the various methods is an electrophotographic method. The electrophotographic method is defined by a process of forming a latent image through exposure by charging the surface of a photoreceptor, developing a latent image by applying toner to the latent image, and transferring and fixing the developed toner onto printing paper.

A fuser for fixing an image on printing paper has been employed to an image forming apparatus.

DISCLOSURE OF INVENTION

BRIEF DESCRIPTION OF DRAWINGS

The above and other aspects, features, and advantages of various examples of the disclosure will be more apparent from the following description taken in conjunction with the accompanying drawings, in which:

FIG. 1 is a schematic block diagram of an image forming apparatus, according to an example;

FIG. 2 is a schematic block diagram illustrating a more detailed configuration of an image forming apparatus, according to an example;

FIG. 3 is a view illustrating a print engine, according to an example;

FIGS. 4 to 6 are views illustrating a fuser, according to an example;

FIG. 7 is a view illustrating a combination of operation duties of a first heater and a second heater using waveform number control, according to an example;

FIG. 8 is a view illustrating a waveform number control operation with 16.7% of an operation duty of a first heater, and various predetermined duties of a second heater, according to an example;

FIG. 9 is a view illustrating a waveform number control operation with 25% of an operation duty of a first heater, and various predetermined duties of a second heater, according to an example;

FIG. 10 is a view illustrating a waveform number control operation with 33% of an operation duty of a first heater, and various predetermined duties of a second heater, according to an example;

FIG. 11 is a view illustrating a waveform number control operation with 50% of an operation duty of a first heater, and various predetermined duties of a second heater, according to an example;

FIG. 12 is a view illustrating a waveform number control operation with 33% of an operation duty of a first heater, and 25% of an operation duty of a second heater, according to an example;

FIG. 13 is a flowchart of a fuser control operation, according to an example; and FIG. 14 is a flowchart of a fuser control operation, according to an example.

Throughout the drawings, it should be noted that like reference numbers are used to depict the same or similar elements, features, parts, components, and structures.

MODE FOR THE INVENTION

Hereinafter, various examples will be described with reference to the drawings. The examples described below may be modified and implemented in various different forms. In order to more clearly describe the features of the examples, a detailed description of matters known to those skilled in the art will be omitted.

When the specification states that one constituent element is "connected to" another constituent element, it includes a case in which the two constituent elements are connected to each other with another constituent element intervened therebetween as well as a case in which the two constituent elements are directly connected to each other. Further, when one constituent element "comprises (or includes)" another constituent element, unless specifically stated to the contrary, it refers to a condition in which other constituent elements may be further included rather than precluding the same.

The expression "image forming job" as used herein may refer to various jobs related with an image, such as, formation of an image or generation/storage/transmission of image files (e.g., printing, copying, scanning, or faxing), and the expression "job" as used herein may refer to not only the image forming job, but also a series of processes required for performance of the image forming job.

Further, the expression "image forming apparatus" as used herein may refer to an apparatus that scans an image of a document and generates a scanned image. Examples of the image forming apparatus may include a scanner, a copier, a printer, a facsimile, or a multi-function printer (MFP) implementing functions of the above. Meanwhile, when the image forming apparatus is a copier, a printer, a scanner, a facsimile, a multi-function printer, or the like, which is capable of the image forming job, the image forming apparatus may also be referred to as the image forming apparatus.

The expression "print data" as used herein may refer to data converted into a formant for printing. If a printer supports direct printing, a file itself could be print data.

The expression "waveform number control" as used herein may refer to controlling energization in a unit of a half-wave of AC power.

The expression "phase control" as used herein may refer to controlling energization of a specific phase of AC power.

The expression "user" as used herein may refer to a person who performs a manipulation related with the image forming job using the image forming apparatus or a device connected to the image forming apparatus in a wired or wireless manner. Further, the expression "manager" as used herein may refer to a person who has authority to access all the functions and systems of the image forming apparatus. The "manager" and the "user" may refer to the same person.

FIG. 1 is a schematic block diagram of an image forming apparatus, according to an example.

Referring to FIG. 1, an image forming apparatus 100 may include a power supply apparatus 110, a print engine 120, and a processor 130.

The power supply apparatus 110 may provide power to each constituent element of the image forming apparatus 100. The power supply apparatus 110 may convert AC power provided from an external source into DC power, and provide the DC power to each constituent element of the image forming apparatus 100.

The power supply apparatus 110 may provide power to a constituent element corresponding to an operation mode of the image forming apparatus 100. For example, when the image forming apparatus 100 is in a print mode, the power supply apparatus 110 may supply power to all the constituent elements of the image forming apparatus 100. Conversely, when the image forming apparatus 100 is in a standby mode, the power supply apparatus 110 may supply power to fewer than all of the constituent elements of the image forming apparatus 100.

The power supply apparatus 110 may selectively provide AC power provided from an external source to a fuser 200. The power supply apparatus 110 may selectively provide AC power to the fuser 200 under the control of the processor 130. The power supply apparatus 110 may selectively include a switching element for outputting AC power, and a zero-cross sensor for detecting zero-cross of AC power.

The print engine 120 may form an image on a printing paper. The print engine 120 may form an image on a printing paper using an electrophotographic method, and fix the image formed on the printing paper by using the fuser 200. An example configuration and operation of the print engine 120 will be described below with reference to FIG. 3.

The processor 130 may control a constituent element of the image forming apparatus 100. The processor 130 may be defined by a single apparatus such as a central processing unit (CPU), or by a plurality of apparatuses such as a clock generation circuit, a CPU, a graphic processor, etc.

The processor 130 may determine an operation mode of the image forming apparatus 100. For example, the processor 130 may determine that a mode is changed from a standby-mode (e.g., a power saving mode) to a normal mode when print data is received, when a power button is pressed, when a signal from an external device (not shown) is received, or the like.

When the printing task is completed and a predetermined period of time passes, the processor 130 may determine an operation mode of the image forming apparatus 100 as a standby mode. The processor 130 may control the power supply apparatus 110 to supply power corresponding to the standby mode.

In the above description, it is described that the image forming apparatus 110 is either in a print mode or in a standby mode. However, it is to be understood that this is merely for ease of description and the image forming apparatus 100 may have other modes. For example, the image forming apparatus 100 may have a warming-up mode for changing a standby node to a normal mode, or have a first standby mode, a second standby, etc. where the number of constituent elements to which power is supplied gradually changes.

Based on the print data being received, the processor 130 may generate binary data by performing a process such as parsing of the received print data, and control the print engine 120 to print the generated binary data.

When a printing task is requested, or an event corresponding to the start of fixing occurs, the processor 130 may control the power supply apparatus 110 to cause the fuser 200 to have a predetermined temperature.

The processor 130 may determine a fixing method. The fixing method may include a first fixing method for performing fixation only with a first heater, and a second fixing method for performing fixation with first and second heaters. Which method to use between the first method and the second method may be determined depending on the size of printing paper where an object is fixed. For example, if fixation is performed in a direction of a longer side of A4 paper, the processor 130 may determine to perform the fixation using the second fixing method.

If fixation is performed in a direction of a shorter side of A4 paper, the processor 130 may determine to perform the fixation using the first fixing method. The processor 130 may perform calorie control by controlling only the first heater based on the temperature detected by the temperature sensor 230 of the fuser 200 of FIG. 5. The term "calorie control" refers to controlling a heat source (or power) supplied to a heater to have a target temperature, and may be performed through waveform number control or phase control, examples of which will be described below.

When it is determined to perform the fixation in the second fixing method using both the first heater and the second heater, the processor 130 may perform the calorie control for each of the first heater and the second heater.

The processor 130 may determine a fuser control method. The fuser control method may include a waveform number control method for controlling a fuser only with a half-wave of AC power, or a phase control method for controlling a fuser only with a specific phase of AC power.

Use of the waveform number control method or the phase control method may be determined based on at least one of an operation mode, an operation duty, a present temperature of a fuser, etc.

In as example, the waveform number control is performed by using only a half-wave, so that a high frequency component is not generated, which is advantageous for harmonics. However, accurate duty control is difficult to perform. The phase control enables easier and more accurate implementation of a duty, which is advantageous for flicker. However, it is disadvantageous for harmonics since many high frequency components are generated.

As described above, the waveform number control may be difficult for accurate duty control, but advantageous for harmonics, and more easily applicable when a predetermined duty (e.g., 16.7%, 25%, 33% and 50% of a duty) is used. In this regard, various examples use the waveform number control in a print mode, and the phase control in other operation modes.

The processor 130 may determine to perform the waveform number control of AC power supplied to the fuser 200 when the operation mode of the image forming apparatus 100 is a print mode, and to perform the phase control of AC power provided to the fuser 200 when the operation mode of the image forming apparatus 100 is a warming up mode, a power saving mode (or standby mode), etc. other than the print mode.

The processor 130 may determine the temperature of the fuser 200, determine an operation duty of the fuser 200 according to the determined temperature and the target temperature, additionally consider (e.g., re-consider) the determined operation duty, and determine a fuser control method.

In an example, the processor 130 may determine to perform the waveform number control of the AC power supplied to the fuser 200 when the determined operation duty is one of predetermined duties and the operation mode of the image forming apparatus 100 is a print mode, and to perform the phase control when the determined operation duty is not a predetermined duty, or the operation mode of the image forming apparatus 100 is not a print mode.

In the above-described operation duty determination process, the processor 130 may determine the use of one of the predetermined duties. For example, when the predetermined duty is 16.7%, 25%, 33% or 50%, and a difference between the target temperature and the present temperature is 15%, the processor 130 may determine to control the fuser 200 with the duty of 16.7% in consideration of an error range.

When the fixing method and the fixation control method are determined according to the operation described above, the processor 130 may control the power supply apparatus 110 to supply AC power to the fuser 200 according to the determined fixing method and fixation control method.

For example, when it is determined to control the fuser 200 by using the first fixing method and the phase control method, the processor 130 may determine the operation duty of the fuser 200 according to the present temperature and the target temperature, and control the power supply apparatus 110 so that only the phase of AC power corresponding to the determined operation duty is provided to the first heater of the fuser 200.

In addition, when it is determined to control the fuser 200 by using the second fixing method and the phase control method, the processor 130 may determine the operation duty of the first heater and the operation duty of the second heater according to the present temperature and the target temperature, and control the power supply apparatus 110 so that each phase of AC power corresponding to the determined operation duty is provided to the first heater and the second heater. In an example, the processor 130 may determine a single operation duty and control the power supply apparatus 100 to supply the same AC power to the first heater and the second heater.

When it is determined to control the fuser 200 by using the first fixing method and the waveform number control method, the processor 130 may control the power supply apparatus 100 so that only the half-wave number corresponding to the determined operation duty is provided to the first heater of the fuser 200. The processor 130 may determine that the number of half-waves corresponding to the determined operation duty, among a plurality of half-wave numbers within a predetermined cycle, may be dispersed within a predetermined cycle, and control the power supply apparatus 110 so that the determined half-wave number may be supplied to the first heater of the fuser 200.

When it is determined to control the fuser 200 by using the second fixing method and the waveform number control method, the processor 130 may control the power supply apparatus 110 so that only the half-wave number corresponding to the determined operation duty with respect to the first heater may be provided to the first heater, and only the half-wave number corresponding to the determined operation duty with respect to the second heater may be provided to the second heater. The processor 130 may control the power supply apparatus 110 so that the same half-wave number may not be simultaneously provided to each of the first heater and the second heater. In order to more easily perform the above-described dispersion operation, the processor 130 may use pre-stored energization information. An example of using the energization information will be described below with reference to FIGS. 8 to 11.

In an example, it may be determined whether to perform the waveform number control or the phase control according to the operation mode of the image forming apparatus 100. In another example, it may be determined whether to perform the waveform number control or the phase control according to the temperature of the fuser 200 or the determined duty. In yet another example, it may be determined whether to perform the waveform number control or the phase control according to at least one of the operation mode, the temperature of the fuser 200, or the determined duty.

In an example, the processor 130 may perform the phase control of AC power provided to a fuser when the temperature of the fuser is out of a predetermined fixation temperature range, and perform the waveform number control of AC power provided to the fuser 200 when the temperature of the fuser is within the predetermined fixation temperature range. For example, when the fixation temperature of the fuser is 300 degrees F., the processor 130 may perform the phase control from a room temperature of less than 270 degrees F., and perform the waveform number control in a range from 270 degrees F. to 330 degrees F.

The processor 130 may determine the operation duty of the fuser corresponding to the temperature of the fuser, perform the waveform number control of AC power provided to the fuser 200 when the determined operation duty is within a predetermined low duty range (e.g., 1 to 50), and perform the phase control of AC power provided to the fuser when the determined operation duty is within a predetermined high duty range (e.g., 51 to 100).

An example configuration of an image forming apparatus has been illustrated and described. However, in other examples, various configurations may be further added. A description of such examples will be made with reference to FIG. 2.

FIG. 2 is a schematic block diagram illustrating a more detailed configuration of an image forming apparatus, according to an example.

Referring to FIG. 2, an image forming apparatus 100 may include the power supply apparatus 110, the print engine 120, the processor 130, a communication device 140, a memory 150, a display 160, and an input device 170.

The power supply apparatus 100 and the print engine 120, including the fuser 200, have been described with reference to FIG. 1, and therefore a repeated description will be omitted. In addition, the processor 130 has been described with reference to FIG. 1, and thus the description made in FIG. 1 will not be repeated, and the configuration added to FIG. 2 will be described below.

The communication device 140 may be configured to connect the image forming apparatus 100 to an external device. The image forming apparatus 100 may be connected to the external device via not only a Local Area Network (LAN) or the Internet, but also a Universal Serial Bus (USB) port and a wireless module. The wireless module may be WiFi, WiFi Direct, Near Field Communication (NFC), Bluetooth, etc.

The communication device 140 may receive a task performance command from a host device (not shown). The communication device 140 may transceive data related to the task performance command. For example, when a task command of a user is printing of a specific file, the communication device 140 may receive a print file.

The print file may be data of a printer language such as Postscript (PS), Printer Control Language (PCL), etc. or a file itself such as PDF, XPS, BMP, JPG, etc.

The memory 150 may store print data received through the communication device 140. The memory 150 may be embodied as a storage medium in the image forming apparatus 100 and an external storage medium, for example, a removable disk including a USB memory, a storage medium connected to a host (Host), a web server through a network, etc.

The memory 150 may store a plurality of duties and energization information with respect to the plurality of duties. The energization information may be information on a half-wave number to be energized within a predetermined cycle with respect to each of the plurality of duties. The energization information may be information on a single heater, or a plurality of heaters. Examples of the energization information on the plurality of heaters are shown in FIGS. 8 to 11.

The display 160 may display various information provided by the image forming apparatus 100. The display 160 may display a user interface window for selecting various functions provided from the image forming apparatus 100.

The input device 170 may include a plurality of function keys supported by the image forming apparatus 100, which are set or selected by a user.

When print data is received from the communication device 140 in a standby mode, the processor 130 may convert an operation mode of the image forming apparatus 100 from the standby mode to the normal mode. The processor 130 may perform the phase control of AC power provided to the fuser 200 so that the fuser 200 may have a predetermined fixation temperature.

When the fuser 200 has a predetermined fixation temperature, the processor 130 may control the print engine 120 so that print data may be printed. The processor 130 may perform the waveform number control of AC power provided to the fuser 200 so that the fuser 200 may maintain a predetermined fixation temperature.

The processor 130 may determine an operation duty for maintaining a fixation temperature, and control the power supply apparatus 110 by using energization information corresponding to the determined operation duty among the operation duties stored in the memory 150.

The image processing apparatus 100 according to an example may use either the phase control method or the waveform number control method according to the operation mode of the image forming apparatus 100. Therefore, harmonics may be reduced by the waveform number control in a print mode. In addition, flicker may be reduced by dispersing a point of time of energization in the waveform number control, and by controlling a plurality of heaters not to be simultaneously energized.

FIG. 3 is a view illustrating a print engine, according to an example.

Referring to FIG. 3, the print engine may include a photoconductive drum 121, a charger 122, an exposure device 123, a developing device 126, a transfer device 125, and a fixing device 200.

An electrostatic latent image may be formed on the photoconductive drum 121. The photoconductive drum 121 may be referred to as a photoconductive drum, a photoconductive belt, etc. depending on its form.

The charger 122 may charge the surface of the photoconductive drum 121 to a uniform potential. The charger 122 may be implemented in the form of a corona charger, a charging roller, a charging brush, or the like.

The exposure device 123 may form an electrostatic latent image on the surface of the photoconductive drum 121 by changing a surface potential of the photoconductive drum 121 according to image information to be printed.

The developing device 126 may include a developer therein and supply a developer to the electrostatic latent image to develop the electrostatic latent image into a visible image. The developing device 126 may include a developing roller 127 which supplies the developer to the electrostatic latent image. For example, the developer may be supplied from the developing roller 127 to an electrostatic latent image formed on the photoconductive drum 121 by a developing electric field formed between the developing roller 127 and the photoconductive drum 121.

The visible image formed on the photosensitive drum 121 may be transferred to a recording medium P by the transfer device 125 or the intermediate transfer belt (not shown).

The fixing device (e.g., fuser) 200 may fix a visible image on the recording medium P by applying heat or pressure to the visible image on the recording medium P. A printing job may be completed by a series of processes. The fuser 200 may be heated by a single heater, or a plurality of heaters. When the fuser 200 is defined by a plurality of heaters, an example configuration and operation thereof will be described with reference to FIGS. 4 to 6.

FIGS. 4 to 6 are views illustrating a fuser, according to an example. In more detail, FIG. 4 is a view illustrating an example of a side shape of a fuser, FIG. 5 is a view illustrating an example of an arrangement form of a sensor for detecting a temperature of a heating roller, and FIG. 6 is an example of an arrangement form of a heater unit in a heating roller.

Referring to FIGS. 4 to 6, the fuser 200 may fix a charging toner on printing paper by applying heat and pressure to the printing paper. The fuser 200 may include a heating roller 210, a pressure roller 220, and a sensor 230.

The heating roller 210 may provide heat to printing paper so that the charging toner may be fixed onto the printing paper. The heating roller 210 may include a first heater 211, and a second heater 212 in a cylindrical substrate, and an elastic layer and a release layer may be disposed on the substrate.

The first heater 211 may be disposed at the center based on a direction perpendicular to a direction in which printing paper moves (e.g., an axis direction of a heating roller). For example, the first heater 211 may have a length corresponding to a shorter side of A4 paper. The first heater 211 may be heated by using AC power provided from a power supply apparatus.

The second heater 212 may be disposed on both sides of the first heater 211 based on a direction perpendicular to a direction in which printing paper moves. For example, the second heater 212 may consist of two parts having half of a length obtained by subtracting a smaller length of A4 paper from a greater length of A4 paper. The second heater 212 may be heated by using AC power provided from a power supply apparatus.

The pressure roller 220 may provide pressure to printing paper so that the charging toner on the printing paper may be fixed onto the printing paper. The heating roller 210 may be attached to the surface of the pressure roller 220 to maintain a constant nip. The pressure roller 220 may be provided with an elastic layer and a release layer on its upper part of a cylindrical core.

The sensor 230 may detect a temperature of a central area of the heating roller 210. The central area may be a notification area through which printing paper passes. In an example, the sensor 230 may be a non-contact temperature sensor, which is not in contact with the heating roller 210.

In other examples, the sensor 230 may be embodied as a contact temperature sensor, and embodied with a plurality of sensors as well as a single sensor. In other words, the single sensor may be disposed at the central area of the heating roller 210, and another sensor may be disposed on a side surface area of the heating roller 210 (e.g., an upper area of the second heater).

In an example, the heating roller 210 may include two heater units. However, in other examples, three or more heater units may be provided. Also, two or more sensors may be provided.

FIG. 7 is a view illustrating a combination of operation duties of a first heater and a second heater using waveform number control, according to an example.

It is assumed that the number of waveforms is controlled in a unit of twelve half-waves (e.g., 6 cycles of AC power), and in this case, 16.7%, 25%, 33%, and 50% of the duty will be used as a predetermined duty.

Referring to FIG. 7, the first heater 211 (i.e., center or lamp 1) and the second heater 212 (i.e., side or lamp 2) each may have 4 (four) predetermined duties.

When the first heater 211 performs the waveform number control with the duty of 16.7%, the processor 130 may perform the waveform number control by using energization information as shown in FIG. 8, described below.

When the first heater 211 performs the waveform number control with the duties of 25%, 33%, and 50%, the processor 130 may perform the waveform number control by using energization information as respectively shown in FIGS. 9, 10 and 11, described below.

An example is provided in which 4 (four) predetermined duties are used on the assumption that twelve half-waves (6 cycles of AC power) is one cycle. In other examples, the predetermined cycle (i.e. the number of half-waves) may be controlled, and the number of predetermined duties may vary accordingly.

FIG. 8 is a view illustrating a waveform number control operation with 16.7% of an operation duty of a first heater and various predetermined duties of a second heater, according to an example.

Referring to FIG. 8, numbers 1 to 12 at the top indicate $1^{st}$ to $12^{th}$ half-waves corresponding to a predetermined cycle, and an area including number "1" in each row indicates that the half-wave is energized. For example, when the energization duty for the first heater 211 is 16.7%, and the energization duty for the second heater 212 is 16.7%, the second and tenth half-waves may be provided to the first heater 211, and the fourth and eighth half-waves may be provided to the second heater 212.

Accordingly, the half-waves provided to the first heater 211 and the second heater 212 may be second, fourth, eighth, and tenth half-waves, and evenly dispersed in one cycle.

FIG. 9 is a view illustrating a waveform control operation with 25% of an operation duty of a first heater, and various predetermined duties of a second heater, according to an example.

Referring to FIG. 9, when the energization duty for the first heater 211 is 25%, and the energization duty for the second heater 212 is 25%, the first, fifth, and ninth half-waves may be provided to the first heater 211, and the third, seventh, and eleventh half-waves may be provided to the second heater 212.

FIG. 10 is a view illustrating a waveform control operation with 33% of an operation duty of a first heater, and various predetermined duties of a second heater, according to an example.

Referring to FIG. 10, when the energization duty for the first heater 211 is 33%, and the energization duty for the second heater 212 is 33%, the second, fifth, eighth, and eleventh half-waves may be provided to the first heater 211, and the third, sixth, ninth, and twelfth half-waves may be provided to the second heater 212.

FIG. 11 is a view illustrating a waveform control operation with 50% of an operation duty of a first heater, and various predetermined duties of a second heater, according to an example.

Referring to FIG. 11, when the energization duty for the first heater 211 is 50%, and the energization duty for the second heater 212 is 50%, the odd-numbered half-waves may be provided to the first heater 211, and the even-numbered half-waves may be provided to the second heater 212.

As the half-wave number supplied to the heater is dispersed in one cycle, the heater can be heated more efficiently. In addition, it is possible to effectively prevent flicker since two heaters do not use the same half-wave number at the same time.

FIG. 12 is a view illustrating a waveform control operation with 33% of an operation duty of a first heater, and 25% of an operation duty of a second heater, according to an example.

Referring again to FIG. 10, when the energization duty for the first heater 211 is 33%, and the energization duty for the second heater 212 is 25%, the first, fourth, eighth, and twelfth half-waves may be provided to the first heater 211, and the third, sixth, and tenth half-waves may be provided to the second heater 212.

In this regard, referring to FIG. 12, the processor 130 may perform the energization control so that the first half-wave of AC power may be provided to the first heater 211, and the second half-wave may not be energized.

For example, the processor 130 may perform the energization control so that the third half-wave may be provided to the second heater 212, and the fourth half-wave may be provided to the first heater 211. The above process may be repeated in a unit of 12 half-waves.

In an example, the processor 130 may directly control the energization. In another example, the processor 130 may provide energization information corresponding to the determined duty to the power supply apparatus 110, and selectively provide the half-wave to the fuser 200 based on the information provided from the power supply apparatus 110.

According to an example, the power supply apparatus 110 selectively provides AC power to the fuser 200. In another example, the power supply apparatus 110 may continuously provide AC power to the fuser 200, and selectively use AC power by using a switching element on the fuser 200.

FIG. 13 is a flowchart of a fuser control operation, according to an example.

Referring to FIG. 13, AC power provided to the fuser 200 may be phase controlled at operation 51310. The AC power provided to the fuser 200 may be phase controlled when it is necessary to raise a temperature of the fuser 200 to a predetermined temperature for performing a printing task upon receiving print data from an external device, or when it is necessary to maintain a temperature of the fuser 200 to a predetermined standby temperature in a standby mode.

The operation mode of the image forming apparatus may be determined at operation S1320. In an example, it is determined if the operation mode is a print mode. The operation mode of the image forming apparatus 100 may be determined considering whether print data is received from an external device, and whether the temperature of the fuser 200 reaches a predetermined fixation temperature. For example, when the print data is received, but the temperature of the fuser 200 does not reach the fixation temperature, the operation mode may be confirmed as a warming-up mode. When the print data is received, and the temperature of the fuser 200 reaches the fixation temperature to print, the operation mode may be confirmed as a print mode.

When the operation mode of the image forming apparatus is a print mode at operation S1320-Y, the AC power provided to the fuser 200 may be waveform number controlled at operation S1330. When the operation mode of the image forming apparatus 100 is a print mode, the waveform number control may be performed on the AC power provided to the fuser 200. In an example, the waveform number control may be performed only when both the operation mode of the image forming apparatus and the determined operation duty of the fuser 200 are satisfied. In another example, the operation duty of the fixing device 200 may be considered as will be described below with reference to FIG. 14.

FIG. 14 is a flowchart of a fuser control operation, according to an example.

Referring to FIG. 14, the operation mode of the image forming apparatus may be confirmed at operation 51410. For example, it may be confirmed whether the operation mode of the image forming apparatus 100 is a standby mode, a warming-up mode, or a print mode.

When it is determined that the confirmed operation mode of the image forming apparatus 100 is a print mode at operation S1420-Y, the operation duty may be determined based on the present temperature and the target temperature at operation S1430. When the fuser 200 is embodied with a plurality of heaters, the operation duty of each heater may be determined.

It is determined whether the determined operation duty is one of the predetermined or assigned operation duties at operation S1440. The predetermined or assigned operation duty may be one of 16.7%, 25%, 33%, or 50%.

When the determined operation duty is one of the predetermined or assigned operation duties at operation S1440-Y, AC power supplied to a fuser may be controlled using a waveform number control method at operation 51450.

Conversely, when it is determined that the operation mode of the image forming apparatus 100 is not a print mode at operation S1420-N, the operation duty may be determined based on the present temperature and the temperature corresponding to the present operation mode at operation S1460, and AC power supplied to the fuser 200 may be controlled using a phase control method according to the determined operation duty at operation S1470.

If the operation mode of the image forming apparatus 100 is a print mode, but it is determined that the determined operation duty is not a predetermined operation duty at operation S1440-N, AC power supplied to the fuser 200 may be controlled using a phase control method at operation S1470.

The above processes may be repeated during a printing task process, and, when the printing task is completed at operation S1480-Y, a fuser control operation may be terminated.

As described above, a fuser control method may be a phase control method or a waveform number control method according to the operation mode of the image forming apparatus 100. Therefore, in a print mode, harmonics may be reduced by performing the waveform number control. In addition, when the waveform number control is performed, a point of time of energization may be dispersed, and a plurality of heaters may be controlled not to be simultaneously energized, thereby reducing flicker.

Meanwhile, the above-described fuser control method may be embodied as a program and provided to an image forming apparatus. For example, the program including the fuser control method may be stored in a non-transitory computer readable medium.

The non-transitory computer readable medium refers to a medium that stores data semi-permanently rather than storing data for a very short time, such as a register, a cache, and a memory, and is readable by an apparatus. For example, the above-described various applications or programs may be stored in a non-transitory computer readable medium such as a compact disc (CD), a digital versatile disk (DVD), a hard drive, a Blu-ray disk, a universal serial bus (USB) memory stick, a memory card, a read only memory (ROM), etc., and may be provided.

Although examples have been shown and described, it will be appreciated by those skilled in the art that changes may be made to these examples without departing from the principles and spirit of the present disclosure. Accordingly, the scope of the present invention is not construed as being limited to the described examples, but is defined by the appended claims as well as equivalents thereto.

The invention claimed is:

1. An image forming apparatus, comprising:

a print engine including a fuser, the fuser including a sensor to detect a temperature of the fuser;

a memory to store a plurality of duties and energization information on each of the plurality of duties;

a power supply apparatus to selectively provide AC power to the fuser; and a processor to control the power supply apparatus to selectively provide the AC power to the fuser, wherein the processor;

determines an operation duty of the fuser according to the detected temperature, based on an operation mode of the image forming apparatus being a print mode and based on the determined operation duty being one of the plurality of duties which are stored in the memory, performs waveform number control of the AC power provided to the fuser, and, based on the operation mode of the image forming apparatus being an operation mode except for the print mode or based on the determined operation duty being different from the plurality of duties stored in the memory, performs phase control of the AC power provided to the fuser.

2. The image forming apparatus as claimed in claim 1, wherein the processor, based on the operation mode of the image forming apparatus being the print mode and based on the determined operation duty being one of the plurality of duties which are stored in the memory, determines a half-wave number to be energized corresponding to the determined operation duty, among a plurality of half-wave numbers in a predetermined cycle, to be dispersed within the predetermined cycle, and provides only the determined half-wave number of the AC power to the fuser on the predetermined cycle basis.

3. The image forming apparatus as claimed in claim 1, wherein the processor, based on the operation mode of the image forming apparatus being a mode except for the print mode or based on the determined operation duty being different from the plurality of duties stored in the memory, determines a phase corresponding to the determined operation duty, and controls the power supply apparatus to provide only the determined phase of the AC power to the fuser.

4. The image forming apparatus as claimed in claim 1, wherein the processor, based on the operation mode of the image forming apparatus being the print mode and based on the determined operation duty being one of the plurality of duties which are stored in the memory, controls the power supply apparatus by using energization information corresponding to the stored duty.

5. The image forming apparatus as claimed in claim 4, wherein the processor, based on the operation mode of the image forming apparatus being a mode except for the print mode or based on the determined operation duty being different from the plurality of duties stored in the memory, controls the power supply apparatus by using energization information corresponding to a duty approximate to the determined operation duty among the plurality of duties.

6. The image forming apparatus as claimed in claim 4, wherein the plurality of duties are at least two of 16.7%, 25%, 33%, or 50%.

7. The image forming apparatus as claimed in claim 1, wherein the fuser comprises:

a first heater disposed at a center of the fuser; and a second heater disposed on both sides of the fuser, wherein the power supply apparatus provides AC power to each of the first heater and the second heater, and wherein the processor, based on the operation mode of the image forming apparatus being the print mode and based on the determined operation duty being one of the plurality of duties which are stored in the memory, performs waveform number control of each of the AC power provided to the first heater and the second heater.

8. The image forming apparatus as claimed in claim 7, wherein the processor, based on the operation mode of the image forming apparatus being the print mode and based on the determined operation duty being one of the plurality of duties which are stored in the memory, controls the power supply apparatus not to provide AC power to the first heater and the second heater simultaneously.

9. A method for providing AC power to a fuser, the method comprising:

determining an operation duty of the fuser according to a detected temperature of the fuser;

determining whether the determined operation duty is one of a plurality of duties stored in a memory;

determining an operation mode of an image forming apparatus;

performing waveform number control of the AC power provided to the fuser based on the operation mode of the image forming apparatus being a print mode and based on the determined operation duty being one of the plurality of duties which are stored in the memory; and performing phase control of the AC power provided to the fuser based on the operation mode of the image forming apparatus being an operation mode except for the print mode or based on the determined operation duty being different from the plurality of duties stored in the memory.

10. The method as claimed in claim 9, wherein the performing of the waveform number control comprises:

determining a half-wave number to be energized corresponding to the determined operation duty among a plurality of half-wave numbers in a predetermined cycle to be dispersed within the predetermined cycle; and performing the waveform number control to provide only the determined half-wave number of the AC power on the predetermined cycle basis.

11. The method as claimed in claim 9, wherein, based on the operation mode of the image forming apparatus being the print mode and based on the determined operation duty being one of the plurality of stored duties, performing the waveform number control by using energization information corresponding to the stored duty.

12. The method as claimed in claim 9, wherein the fuser comprises:

a first heater disposed at a center of the fuser; and a second heater disposed on both sides of the fuser, and wherein the performing of the waveform number control comprises, based on the operation mode of the image forming apparatus being the print mode and based on the determined operation duty being one of the plurality of duties which are stored in the memory, performing waveform number control of each of AC power provided to the first heater, and AC power provided to the second heater.

13. The method as claimed in claim 12, wherein, based on the operation mode of the image forming apparatus being the print mode and based on the determined operation duty being one of the plurality of duties which are stored in the memory, performing the waveform number control by not providing AC power to the first heater and the second heater simultaneously.

14. A non-transitory computer readable medium including instructions stored thereon to perform a method of providing AC power to a fuser, the non-transitory computer readable medium comprising:

instructions to determine an operation duty of the fuser according to a detected temperature of the fuser;

instructions to determine whether the determined operation duty is one of a plurality of duties stored in a memory;

instructions to determine an operation mode of an image forming apparatus;

instructions to perform waveform number control of the AC power provided to the fuser based on the operation mode of the image forming apparatus being a print mode and based on the determined operation duty being one of the plurality of duties which are stored in the memory; and instructions to perform phase control of the AC power provided to the fuser based on the operation mode of the image forming apparatus being an operation mode except for the print mode or based on the determined operation duty being different from the plurality of duties stored in the memory.

15. The non-transitory computer readable medium as claimed in claim 14, further comprising instructions to, based on the operation mode of the image forming apparatus being the print mode and based on the determined operation duty being one of the plurality of duties which are stored in the memory:

determine a half-wave number to be energized corresponding to the determined operation duty, among a plurality of half-wave numbers in a predetermined cycle, to be dispersed within the predetermined cycle; and provide only the determined half-wave number of the AC power to the fuser on the predetermined cycle basis.

16. The non-transitory computer readable medium as claimed in claim 14, further comprising instructions to, based on the operation mode of the image forming apparatus being a mode except for the print mode or based on the determined operation duty being different from the plurality of duties stored in the memory:

determine a phase corresponding to the determined operation duty; and provide only the determined phase of the AC power to the fuser.

17. The non-transitory computer readable medium as claimed in claim 16, further comprising instructions to, based on the operation mode of the image forming apparatus being the print mode and based on the determined operation duty being one of the plurality of duties which are stored in the memory, use energization information corresponding to the stored duty.

18. The non-transitory computer readable medium as claimed in claim 16, further comprising instructions to, based on the operation mode of the image forming apparatus being a mode except for the print mode or based on the determined operation duty being different from the plurality of duties stored in the memory, use energization information corresponding to a duty approximate to the determined operation duty among the plurality of duties.

19. The non-transitory computer readable medium as claimed in claim 14, wherein the plurality of duties are at least two of 16.7%, 25%, 33%, or 50%.

* * * * *